US008487227B2

(12) United States Patent
Rastegar et al.

(10) Patent No.: US 8,487,227 B2
(45) Date of Patent: Jul. 16, 2013

(54) SPEED-ADAPTIVE DEPLOYABLE BOAT-TAILING CONE FOR MUNITIONS FOR RANGE EXTENSION

(75) Inventors: Jahangir S. Rastegar, Stony Brook, NY (US); Richard T. Murray, Patchogue, NY (US)

(73) Assignee: Omnitek Partners LLC, Ronkonkoma, NY (US)

( * ) Notice: Subject to any disclaimer, the term of this patent is extended or adjusted under 35 U.S.C. 154(b) by 236 days.

(21) Appl. No.: 12/939,147

(22) Filed: Nov. 3, 2010

(65) Prior Publication Data

US 2011/0271864 A1 Nov. 10, 2011

Related U.S. Application Data

(60) Provisional application No. 61/259,178, filed on Nov. 8, 2009.

(51) Int. Cl.
*F42B 10/44* (2006.01)

(52) U.S. Cl.
USPC ..... 244/3.3; 102/490

(58) Field of Classification Search
USPC ..... 244/3.26, 3.27, 3.3; 102/490
See application file for complete search history.

(56) References Cited

U.S. PATENT DOCUMENTS

| | | | | | |
|---|---|---|---|---|---|
| 399,880 | A * | 3/1889 | Graydon et al. | ..... | 244/3.27 |
| 2,297,130 | A * | 9/1942 | Bomar | ..... | 244/3.27 |
| 3,282,216 | A * | 11/1966 | Calfee et al. | ..... | 244/159.1 |
| 3,412,962 | A * | 11/1968 | Killian | ..... | 244/130 |
| 3,494,284 | A * | 2/1970 | Gross | ..... | 102/491 |
| 3,710,715 | A * | 1/1973 | Hoofnagle | ..... | 102/386 |
| 3,809,339 | A * | 5/1974 | Sieling et al. | ..... | 244/3.3 |
| 3,888,175 | A * | 6/1975 | Dusoe et al. | ..... | 102/386 |
| 4,561,357 | A * | 12/1985 | Maudal et al. | ..... | 102/439 |
| 4,674,706 | A * | 6/1987 | Hall | ..... | 244/3.3 |
| 6,657,174 | B1 * | 12/2003 | Olsson | ..... | 244/3.3 |
| 7,874,251 | B1 * | 1/2011 | Fu | ..... | 102/399 |
| 7,997,205 | B2 * | 8/2011 | Greenwood et al. | ..... | 102/490 |
| 2007/0261543 | A1 * | 11/2007 | Elder | ..... | 89/8 |
| 2011/0024549 | A1 * | 2/2011 | McDermott et al. | ..... | 244/3.3 |
| 2011/0024550 | A1 * | 2/2011 | McDermott et al. | ..... | 244/3.27 |

* cited by examiner

*Primary Examiner* — Benjamin P Lee

(57) ABSTRACT

A base cone for a projectile including: a cone member being movable between a retracted position and an extended deployed position, the deployed position being longer in an axial direction than the refracted position; a member adapted to connect the cone member to a trailing portion of the projectile; and a release mechanism for releasing the cone member from the refracted position to the extended deployed position.

4 Claims, 13 Drawing Sheets

SPEED-ADAPTIVE DEPLOYABLE BOAT-TAILING CONE FOR MUNITIONS FOR RANGE EXTENSION

CROSS-REFERENCE TO RELATED APPLICATION

This application claims the benefit of U.S. Provisional Application No. 61/259,178 filed on Nov. 8, 2009, the entire contents of which is incorporated herein by reference.

BACKGROUND OF THE INVENTION

1. Field of the Invention

The present invention relates generally to munitions, and more particularly to a speed-adaptive deployable boat-tailing cone for munitions for range extension.

2. Prior Art

Boat-tailing consists of the reduction of the aft cross-sectional area of a flying object in order to reduce drag. Boat-tailing is most effective and critical for supersonic flights. For each speed of a projectile and the flying altitude, there is an optimal boat-tailing angle. For example, if the boat-tailing is two extreme, i.e., the aft cross-sectional area is reduced too rapidly along the length of the flying object, then aft shock becomes too strong, boundary layer separation occurs and drag is considerably increased. If the rate of reduction in the aft cross-section is too slow, then the amount of reduction in the drag is minimal.

At supersonic speeds, the optimal boat-tailing cone angle is a function of Mach number. The boat-tailing angle is the largest at the highest projectile speeds and is gradually decreased as the projectile speed approaches the subsonic speeds. It has been shown that base drag accounts for up to 50% of total drag on a projectile during supersonic flight. With base bleed and boat-tailing, drag in supersonic flight has been shown to be significantly reduced.

SUMMARY OF THE INVENTION

It is therefore highly desirable to provide projectiles, particularly gun-fired projectiles, whether subsonic or supersonic, with appropriate boat-tailing to reduce the drag and thereby significantly increase their range.

In addition, it is highly desirable that the boat-tailing section be deployable from an initial configuration that occupies minimal length and volume of the projectile, thereby would neither add significantly to the length of the projectile nor occupy a considerable volume of the projectile.

In addition and particularly for supersonic rounds, the boat-tailing angle can be variable to achieve maximum drag reduction as the speed of the projectile varies. The boat-tailing angle may be made to be varied to a number of discrete angles rather than being varied continuously as the speed of the projectile is reduced. With such a design, a very simple and inexpensive boat-tailing mechanism is achieved that would also not occupy a considerable amount of space.

In most gun-fired munitions, the round is designed with a relatively flat base where it interacts with the high pressure gases generated by the detonated charges to accelerate the round along the gun barrel. Thus, an objective is to provide the method and the means of providing boat-tailing cones (hereinafter also referred to as "base cones") for projectiles, particularly gun-fired projectiles that are retracted to a relatively small volume at the base of the projectile and deployed after the projectile has exited the gun barrel. The base cones may be deployed automatically upon the round exiting the barrel or may be programmed to deploy certain amount of time into the flight or following the detection of certain event (s).

Accordingly, a base cone for a projectile is provided. The base cone comprising: a cone member being movable between a retracted position and an extended deployed position, the deployed position being longer in an axial direction than the retracted position; a member adapted to connect the cone member to a trailing portion of the projectile; and a release mechanism for releasing the cone member from the retracted position to the extended deployed position.

The cone member can be tapered from a first diameter at the trailing edge of the projectile to a second diameter, the second diameter being smaller than the first diameter. The base cone can further comprise a cap disposed to cover the second diameter. The base cone can further comprise a mass disposed on at least a portion of the cone member for facilitating extension of the cone member into the extended deployed position due to an acceleration of the projectile.

The cone member can include a helical strip. The helical strip can include stops at an edge of the helical strip for restricting movement of the helical strip in the longitudinal direction.

The cone member can be a bellows. The base cone can further comprise a biasing member for biasing the bellows in the extended deployed position.

The cone member can comprise a plurality of ribbon members having a rolled configuration in the retracted position and at least partially unrolled configuration in the extended deployed position. The plurality of ribbons can be connected to each other. The plurality of ribbons can include stiffening ribs.

The cone member can include a plurality of rings, each successive ring in the longitudinal position is smaller in diameter than the previous ring. The base cone can further comprise one or more linkages connecting two or more of the plurality of rings. The base cone can further comprise a cap disposed to cover a last of the plurality of rings in the longitudinal direction. The base cone can further comprise a biasing member for biasing the plurality of rings in the extended deployed position.

The cone member can includes a plurality of plate members. The plate members can be interconnected.

The release mechanism can be one or more of a cable and bolt. The cable or bolt can be released by one or more of an electrical or explosive initiation.

The release mechanism can include at least first and second release mechanisms, the first release mechanism being adapted to extend the cone member in a first extended deployed position and the second release mechanism being adapted to extend the cone member in a second extended deployed position, the second extended deployed position being longer in the longitudinal direction then the first extended deployed position.

Also provided is a projectile comprising: a shell having a base; and a base cone connected to the base, the base cone including: a cone member being movable between a refracted position and an extended deployed position, the deployed position being longer in an axial direction than the retracted position; a member adapted to connect the cone member to the base of the projectile; and a release mechanism for releasing the cone member from the retracted position to the extended deployed position.

Still further provided is a method for deploying a base cone from a projectile. The method comprising: firing a projectile, and deploying a cone member disposed on a trailing edge of the projectile from a retracted position to an extended deployed position, wherein the extended deployed position is aft of the trailing edge of the projectile in a longitudinal direction of the projectile.

The cone member can be deployed in a single discrete step from the retracted position to the extended deployed position.

The cone member can be deployed in two or more discrete steps from the refracted position to at least one intermediate position to the extended deployed position.

The deploying can be based on an elapsed time after firing.

The deploying can be based on a speed of the projectile.

BRIEF DESCRIPTION OF THE DRAWINGS

These and other features, aspects, and advantages of the apparatus of the present invention will become better understood with regard to the following description, appended claims, and accompanying drawings where:

FIGS. 1*a*, 1*b* and 1*c* illustrate a first embodiment of a base cone for a munition, in which FIG. 1*a* illustrates the base cone not being deployed, FIG. 1*b* illustrates the base cone being fully deployed and FIG. 1*c* illustrates a partial sectional view of the base cone of FIG. 1*b*.

FIGS. 2*a*, 2*b* and 2*c* illustrate a second embodiment of a base cone for a munition, in which FIG. 2*a* illustrates the base cone not being deployed, FIG. 2*b* illustrates the base cone being fully deployed and FIG. 2*c* illustrates a sectional view of the base cone of FIG. 2*a*.

FIGS. 3*a*, 3*b*, 3*c* and 3*d* illustrate a third embodiment of a base cone for a munition, in which FIG. 3*a* illustrates the base cone not being deployed, FIG. 3*b* illustrates the base cone being fully deployed, FIG. 3*c* illustrates a portion of the base cone of FIG. 3*a* and FIG. 3*d* illustrates the portion of FIG. 3*c* being deployed.

FIGS. 5*a*, 5*b*, 5*c*, 5*d* and 5*e* illustrate a fourth embodiment of a base cone for a munition, in which FIG. 5*a* illustrates a perspective view of the base cone not being deployed, FIG. 5*b* illustrates a perspective sectional view of the base cone of FIG. 5*a*, FIG. 5*c* illustrates a side perspective view of the base cone of FIG. 5*a*, FIG. 5*d* illustrates the base cone of FIG. 5*a* being partially deployed and FIG. 5*e* illustrates a sectional view of the base cone being fully deployed.

FIGS. 6*a*, 6*b*, 6*c* and 6*d* illustrate a fifth embodiment of a base cone for a munition, in which FIG. 6*a* illustrates the base cone not being deployed, FIG. 6*b* illustrates a sectional of the base cone of FIG. 6*a*, FIG. 6*c* illustrates a sectional of the base cone being fully deployed and FIG. 6*d* illustrates a portion of the base cone of FIG. 6*c* being deployed.

FIGS. 7*a*, 7*b* and 7*c* illustrate a sixth embodiment of a base cone for a munition, in which FIG. 7*a* illustrates a portion of the base cone being fully deployed, FIG. 7*b* illustrates the base cone not being deployed and FIG. 7*c* illustrates the portion of FIG. 7*a* when not deployed.

FIG. 8*a* illustrates an undeployed state and FIG. 8*b* illustrates a fully deployed state.

FIG. 9*a* illustrates an undeployed state and FIG. 9*b* illustrates a fully deployed state.

DETAILED DESCRIPTION OF THE PREFERRED EMBODIMENT

Figure 1A:
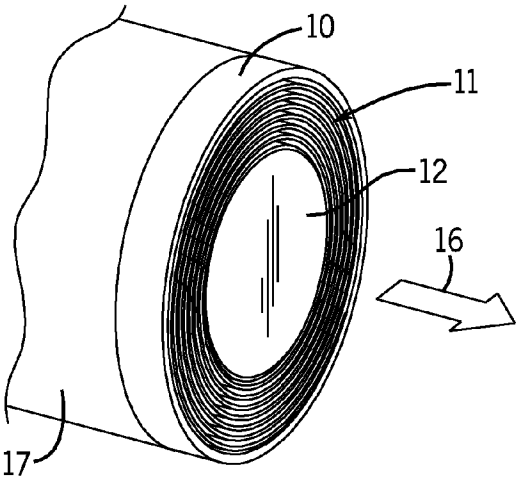
Figure 1B:
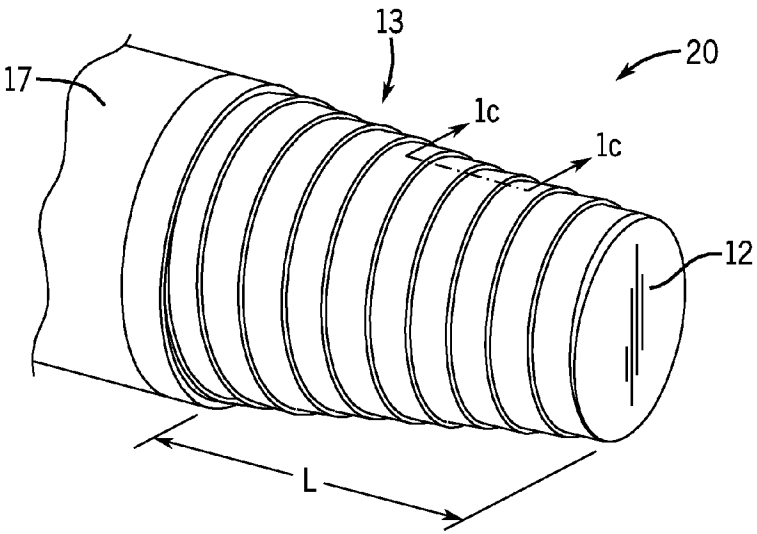
Figure 1C:
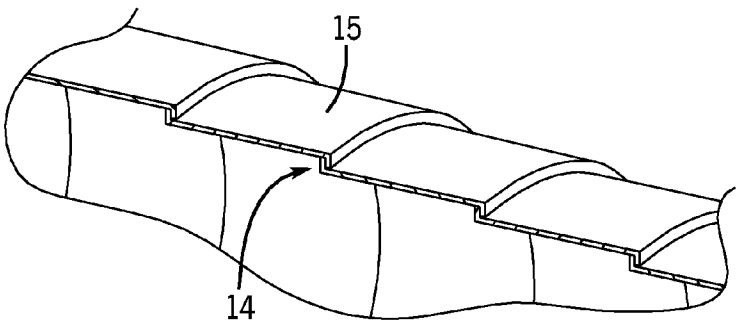

The first embodiment of the base cone 20 is shown in FIGS. 1*a*, 1*b* and 1*c*. The base cone is constructed by a strip 15 (which may be formed of spring steel or the like) that is wound as a tapered helix 13 as shown in FIG. 1*b*. The lips 14 of the strips are formed such that they interlock as shown in FIG. 1*c*. In the pre-deployed configuration, the tapered helix 13 is compressed to form a relatively thin "disc" 11 at the base 10 of the projectile 17. In the pre-deployed configuration, the tapered helix is held in its state via certain keeper or locking mechanisms. Numerous types of such locking mechanisms may be used, such as a cable or bolt that may be released electrically or with explosive charges. The locking mechanism may be designed to release the base cone due to the firing (setback) acceleration or set-forward acceleration or by certain programmed action such as release or cutting of a holding cable or any other known methods in the art. The base cone tapered helix 13 can be biased as a helical spring to deploy in the direction of the arrow 16 once it is released by the locking mechanism. The base cone tapered helix 13 may be provided with a cap 12, which is affixed to the last coil of the tapered helix 13. The release mechanism may be provided to release the full length "L" of the base cone at once or may be provided to release portion of such length "L" up until the entire length is released. That is, the entire length "L" of the base cone may be released in stages as a function of time, speed or other factors. The base cone can be attached to the projectile 17 by any means known in the art, or in some cases, at least a portion of the base cone can be formed integrally therewith.

Figure 2B:
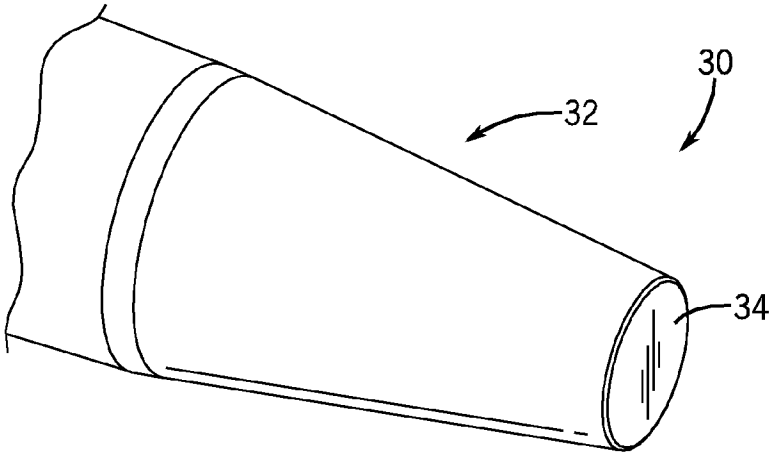
Figure 2C:
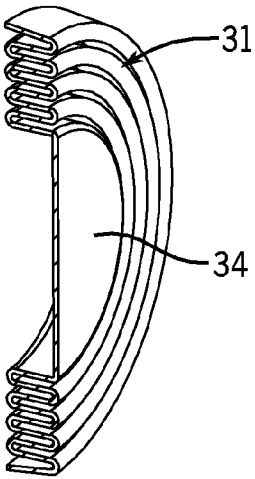
Figure 2A:
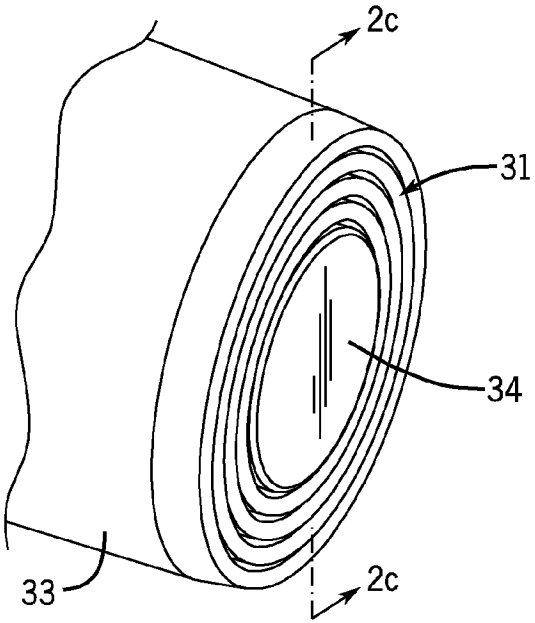

Another embodiment 30 of the tapered base cone is shown in FIGS. 2*a*, 2*b* and 2*c*. The base cone is constructed as a bellows 31 as shown in FIG. 2*a* in its collapsed configuration, with its cutaway view shown in FIG. 2*c*. The bellows 31 may be formed from any material known in the art, such as an elastomer or flexible metal. In its collapsed configuration, the base cone bellow 31 is held in its state via certain keeper or locking mechanisms (as discussed above). Numerous types of such locking mechanisms, such as those described for the previous embodiment may be used to perform this function. The locking mechanism may be designed to release the base cone due to the firing (setback) acceleration or set-forward acceleration or by certain programmed action such as release or cutting of a holding wire or any other known methods in the art. The base cone bellows is fixed to the base of the projectile 33. The base cone bellows 31 can be formed of a material that is biased to deploy out away from the projectile base or can be biased with a biasing member or means to deploy out away from the projectile base into the base cone 32 once it is released by the locking mechanism, which may be all at once or staged in portions. The base cone 32 may be provided with a cap 34, which can be integral to the base cone bellows 31.

Figure 3A:
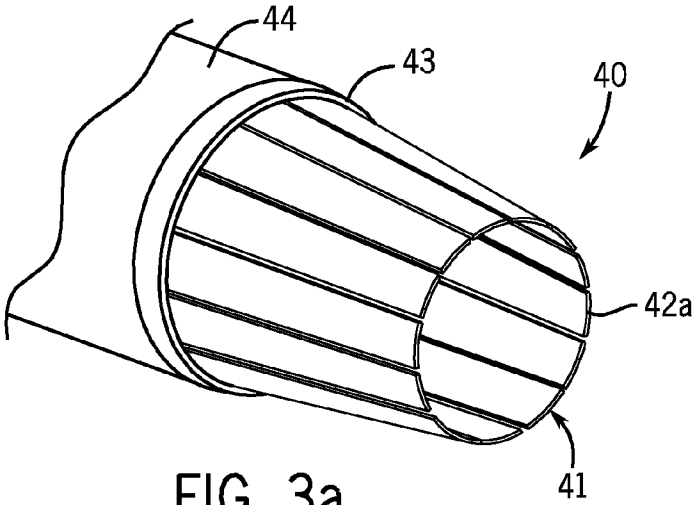
Figure 3D:
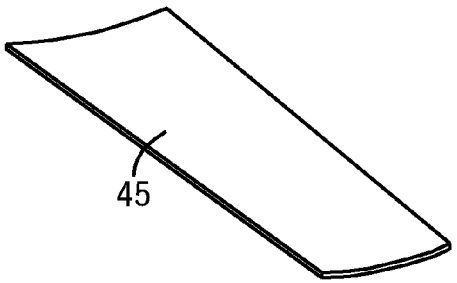
Figure 3B:
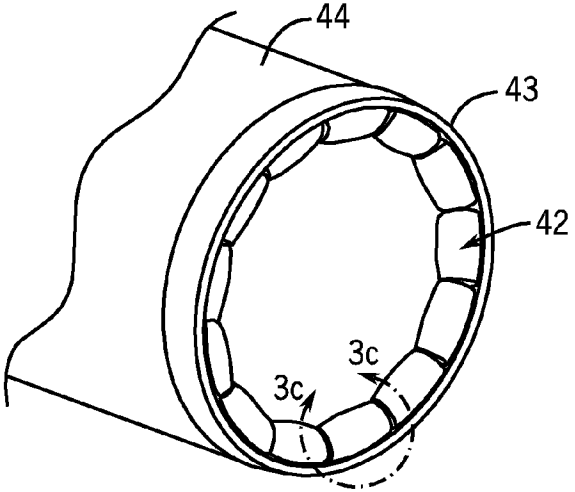
Figure 3C:
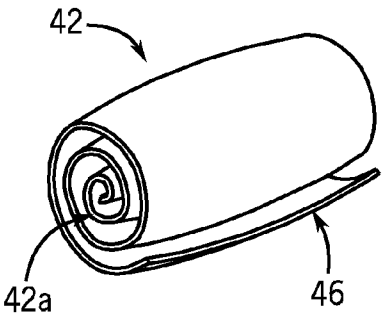

Another embodiment 40 of the tapered base cone is shown in FIGS. 3*a*, 3*b*, 3*c* and 3*d*. The base cone is constructed by a plurality of "ribbons" 41 as shown in FIG. 3*a*, which are formed similar to a retractable tape measure coil or the like to offer higher cantilever stiffness than a flat plate, i.e., with curved cross-sections to make them resistant to bending, but with thin enough thickness so that when bent, they would not cause permanent (plastic) deformation. A circular array of rolled ribbons 42, as shown in their rolled (pre-deployment) configuration in FIG. 3*b*, are mounted to the base 43 of the projectile 44 (shown partially) by any means known in the art or formed integrally therewith, occupying a relatively thin and small volume. A close-up view of a rolled ribbon 42 is shown in FIG. 3*c*. The ribbon 42 in its deployed configuration 45 (forming a portion of the base cone 40) is shown in FIG. 3*d*. The rolled ribbons 42 can be biased to deploy to the configuration 45 shown in FIG. 3*d* (i.e., configuration 41 shown in FIG. 3*a*). However, in the pre-deployment state of the base cone 40, the rolled ribbons 42 are held in their rolled state via certain keeper or locking mechanisms (not shown). Numerous types of such locking mechanisms, such as those described for the previous embodiment may be used to perform this function. The locking mechanism may be designed to release the base cone due to the firing (setback) acceleration or set-forward acceleration or by certain programmed action such as release or cutting of a holding cable or bolt or any other known methods in the art. The rolled ribbons 42 are biased to deploy out away from the projectile base 43 (and the projectile 44) into the base cone 40 once they are released by the locking mechanism. The base cone 40 may be provided with a cap (not shown), which is affixed to the tip 46 of the rolled ribbons 42. An end 42*a* of each of the ribbons 42 can be provided with a relatively heavy mass which unfolds the ribbon when the ribbon experiences the firing acceleration.

Figure 4B:
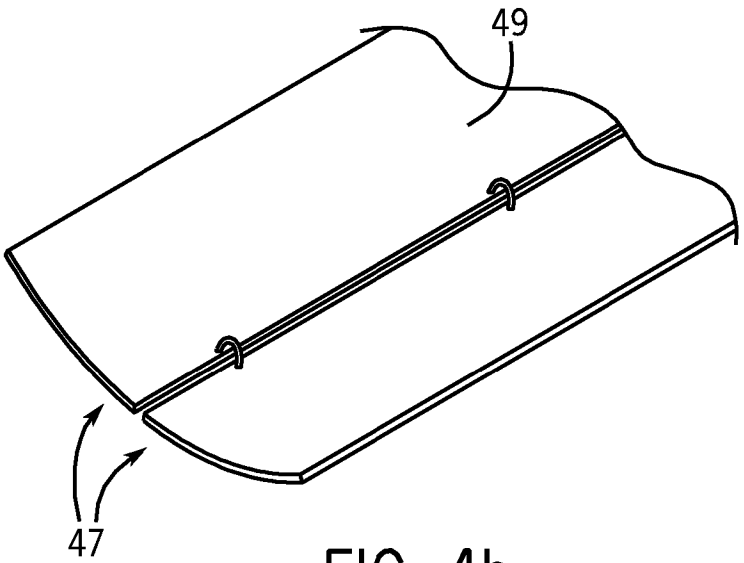
FIGS. 4*a* and 4*b* illustrate first and second variations of the third embodiment.
Figure 4A:
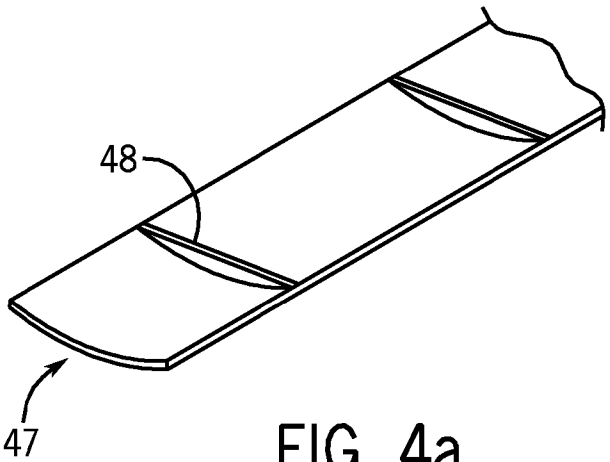

The ribbons 41 (FIG. 3*a* and as shown individually in FIG. 3*d* and enumerated as 45) may be stiffened against bending in their deployed configurations in many different ways. For example, deployed ribbons 47 may be provided with gussets 48 as shown in FIG. 4*a*. The adjacent ribbons 47 may also be held together with elements such as rings 49 (or wires or the like) as shown in FIG. 4*b*.

Figure 5A:
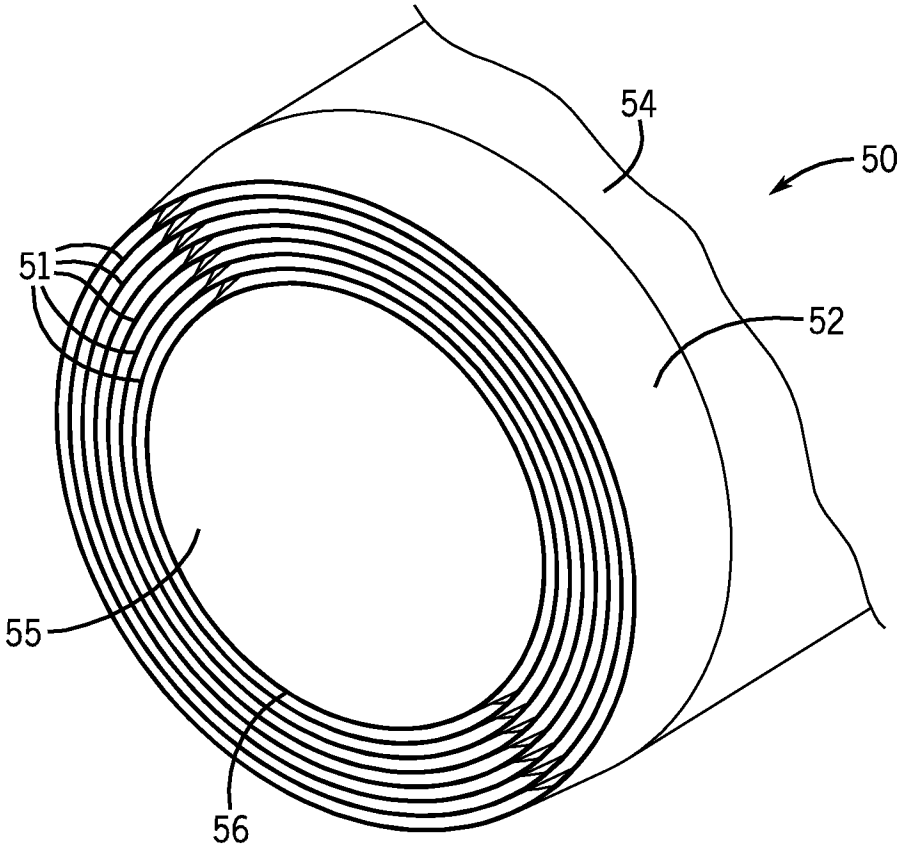
Figure 5B:
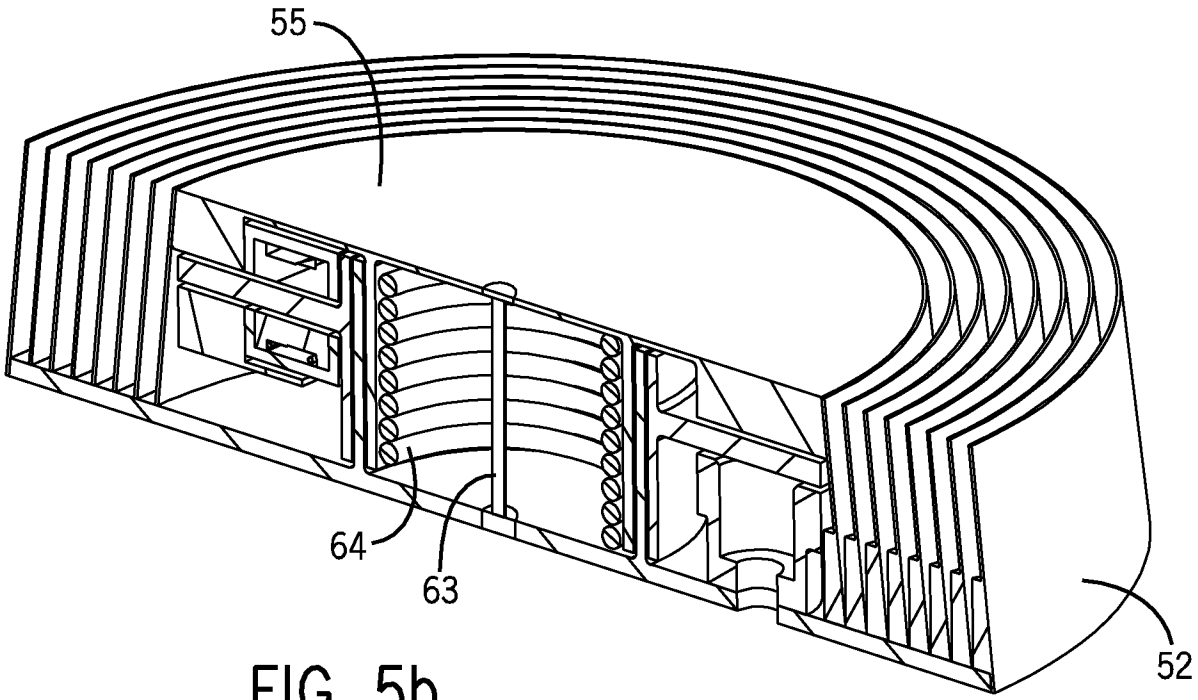
Figure 5C:
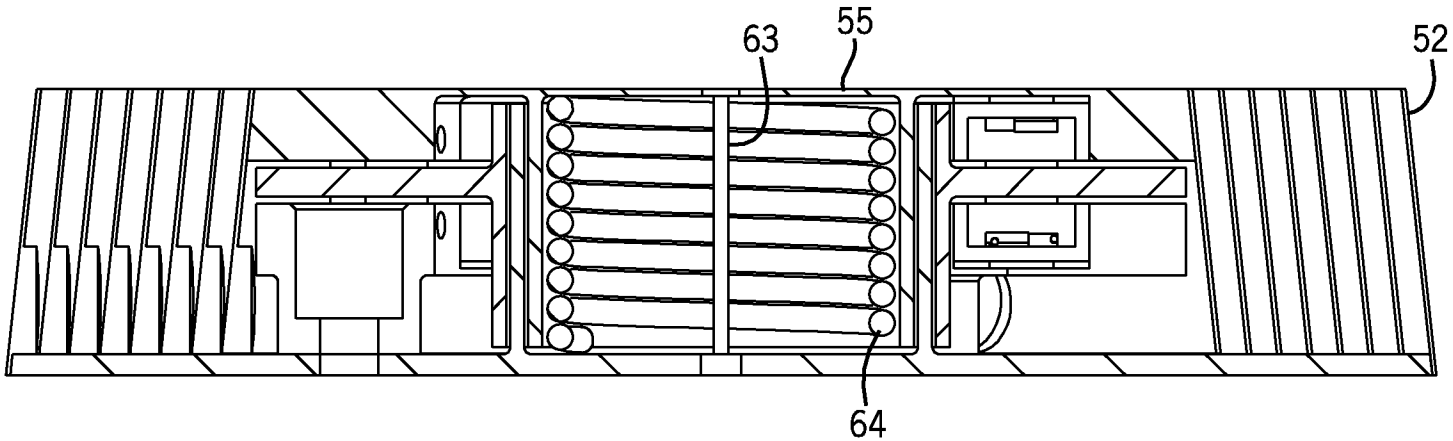
Figure 5D:
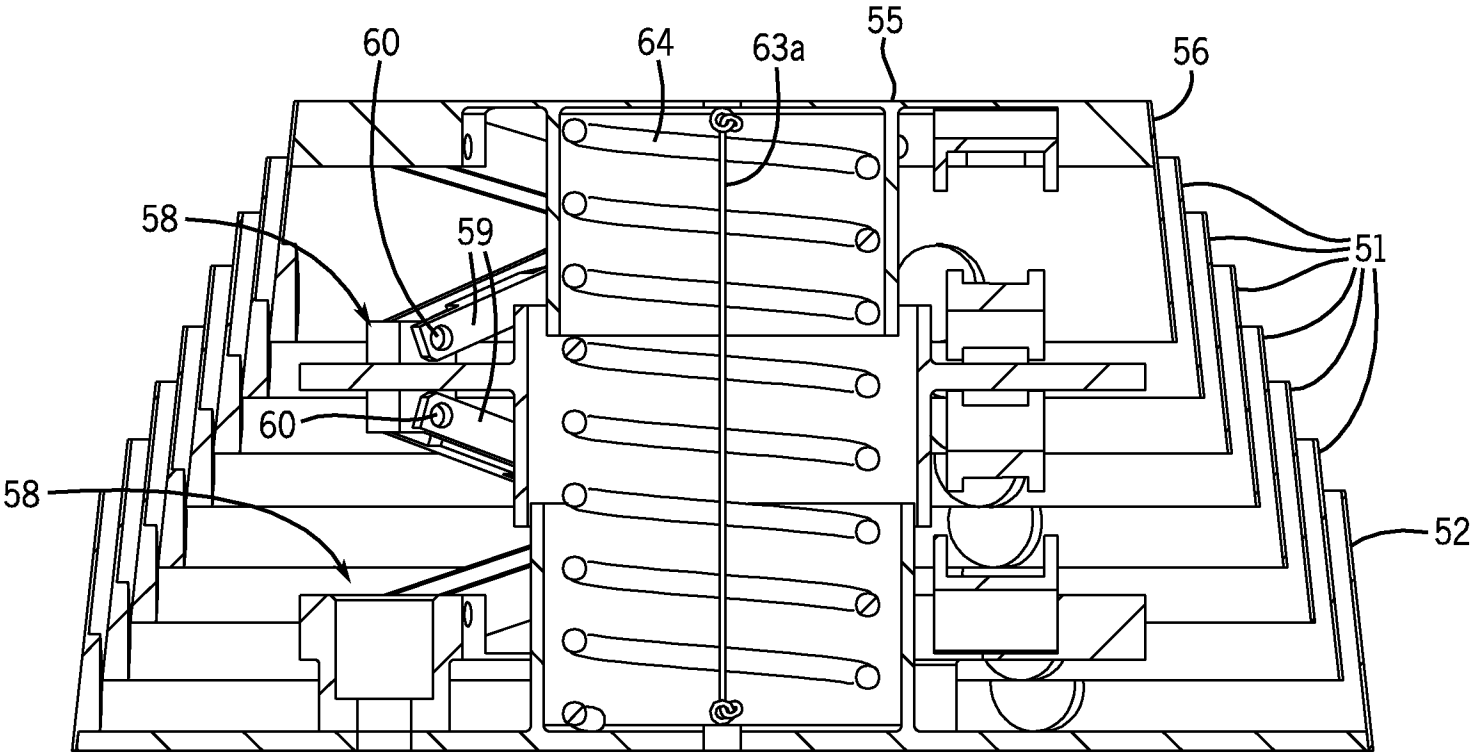
Figure 5E:
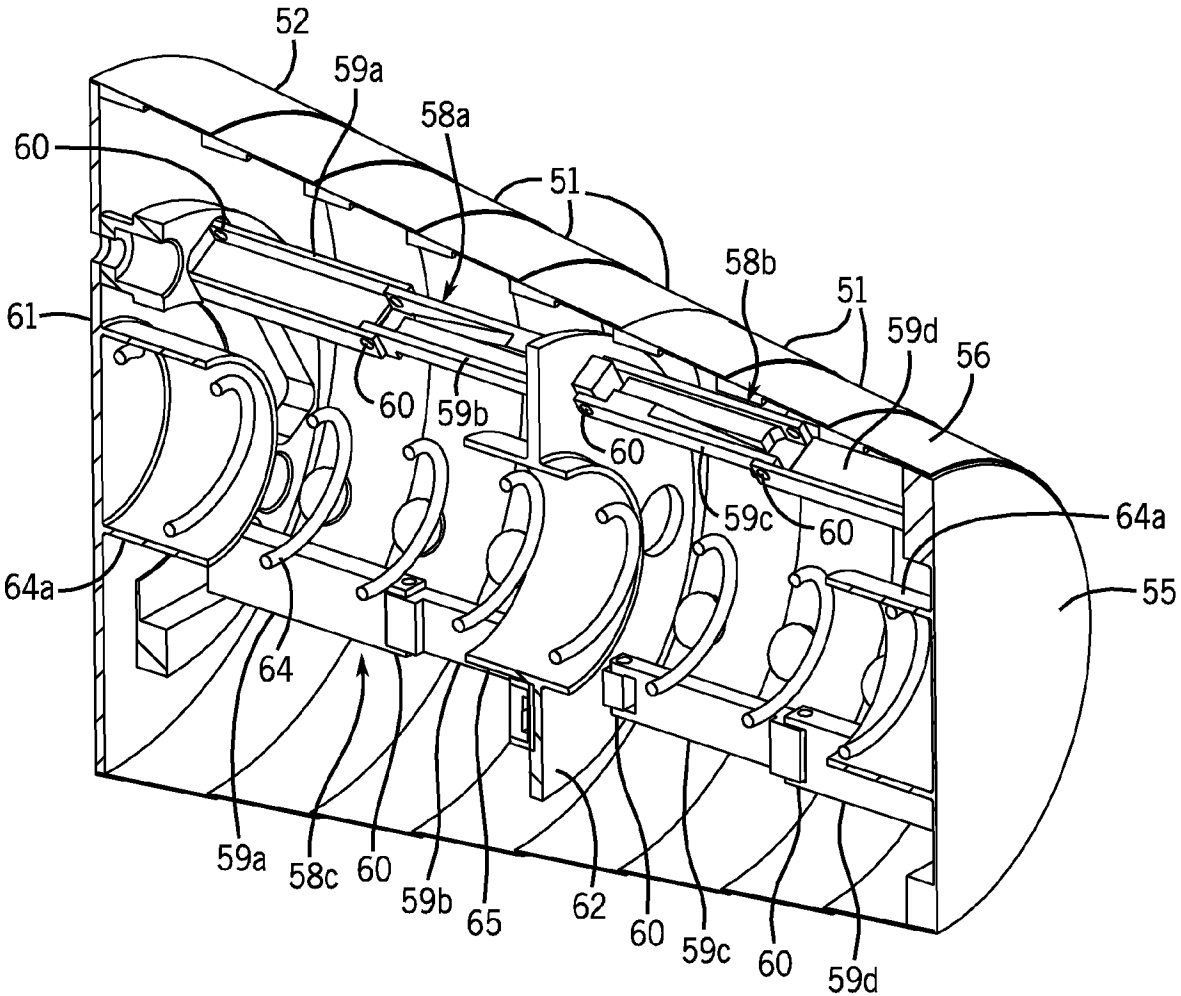

In yet another embodiment, the base cone 50 has a telescopic design and is constructed with a number of "ring" type segments 51 as shown in FIGS. 5*a*-5*e*. The segments can have interlocking lips (not shown) similar to those shown for the embodiment 20 as shown in FIG. 1*c*. The first ring segment 52 is affixed to the base of the projectile 54. The base cone 50 is preferably provided with a cap 55, which is affixed or is preferably integral to the last ring 56 as shown in FIG. 5*b*. In the pre-deployed configuration shown in FIG. 5*a*, the telescopic rings 51, 52 and 56 are held together by one or more link mechanisms 58. As shown in FIGS. 5*d* and 5*e*, the link mechanisms 58 can have link arms 59 rotatably connected at pivot points 60. The link mechanisms can also be provided in pairs 58*a*, 58*b* as shown in FIG. 5*e* and such pairs can be provided in several sets (58*c*, 58*d*) at angular intervals around the base cone. FIGS. 5*d* and 5*e* illustrate link mechanisms 58*a*, 58*c* having one link 59*a* pivotably connected to a base plate 61 at one end and to the other link arm 59*b* at the other end and the link 59*b* being pivotally connected to an intermediate plate 62 at the other end. Similarly, FIGS. 5*d* and 5*e* illustrate link mechanisms 58*b*, 58*d* having one link 59*c* pivotably connected to the intermediate plate 62 at one end and to the other link arm 59*d* at the other end and the link 59*d* being pivotally connected to the cap 55 at the other end.

The telescopic rings 51, 52 and 56 are maintained in their un-deployed state as shown in FIGS. 5*a*-5*c* via certain keeper or locking mechanisms, such as a cable 63 or bolt 63 that can be disengaged electrically or via an explosive charge as is well known in the art. Numerous types of such locking mechanisms may be used. The locking mechanism may also be designed to release the base cone due to the firing (setback) acceleration or set-forward acceleration or by certain programmed action such as release or cutting of the holding cable 63 or bolt 63 or any other known methods in the art. As discussed above with regard to the embodiment of FIG. 1*a*, the locking mechanism can be provided in stages, such as a secondary cable 63*a* or bolt 63*a* as shown in FIG. 5*d* that maintains the telescopic rings 51, 52 and 56 in an intermediate position between un-deployed and fully deployed. The secondary cable 63*a* or bolt may be released in the same manner as the primary cable 63 or bolt 63 after an elapsed time period or upon sensing a predetermined criteria, such as speed.

Once released, the telescopic rings 51, 52 and 56 can be biased in the deployed configuration shown in FIGS. 5*d* and 5*e*, such as with compression spring 64, an inflatable balloon or other means known in the art. The compression spring 64 can be maintained in the base cone by holding cups 64*a* in the base plate 61 and cap 55 and an intermediate open cup 65 in the intermediate plate 62.

Figure 6C:
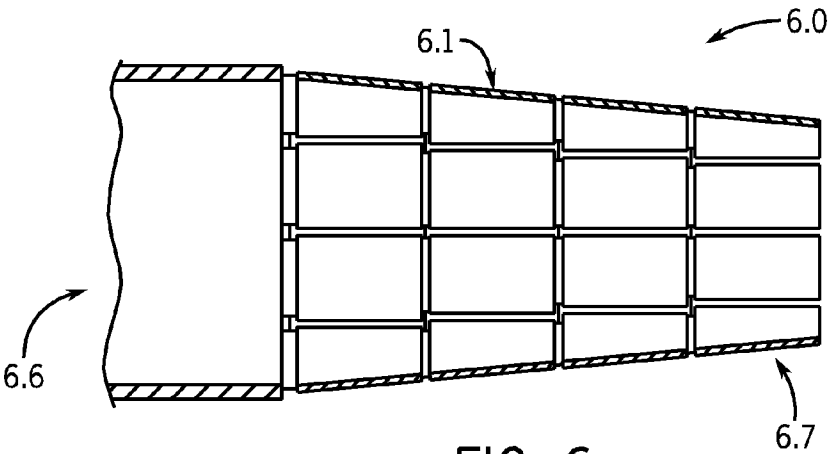
Figure 6D:
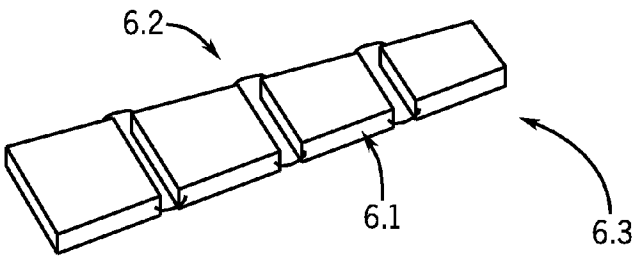
Figure 6A:
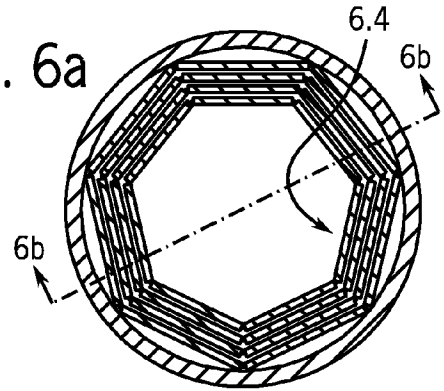
Figure 6B:
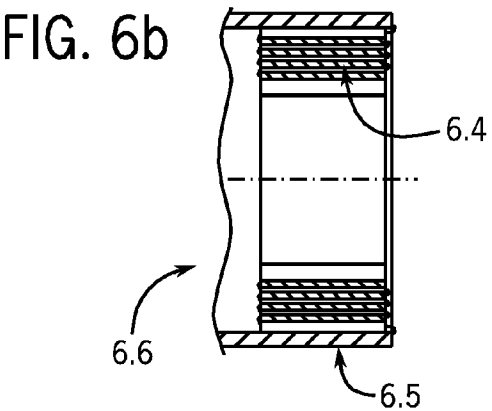

In yet another embodiment, the base cone 6.0 consists of panels 6.1 which are held together longitudinally by flexible elements 6.2. In the pre-deployed configuration of the base cone 6.0, each set of longitudinal panels 6.3 shown in FIG. 6*d* is "rolled up" (indicated by numeral 6.4 in FIGS. 6*a* and 6*b*), and stored at the base (preferably in a "housing segment 6.5 as shown in FIG. 6*b*) of the projectile 66. In the pre-deployed configuration shown in FIGS. 6*a* and 6*b*, rolled-up panels 6.4 are held in their un-deployed state via certain keeper or locking mechanisms (not shown). Numerous types of such locking mechanisms may be used. The locking mechanism may be designed to release the base cone due to the firing (setback) acceleration or set-forward acceleration or by certain programmed action such as release or cutting of a holding wire or any other known methods in the art. The panels 6.1 of the longitudinal panel sets 6.3 may be held together at certain intervals by certain means such as elastic elements or the like (not shown) or rings affixed to at least one set of panels located certain distance along the base cone 6.0 to hold the longitudinal panel sets together to the desired shape of the base cone 6.0 and also to provide the means to stiffen the base cone 6.0. The base cone 6.0 may be provided with a cap (not shown), which is affixed to the outer side of the outer panel set 6.7.

Figure 7A:
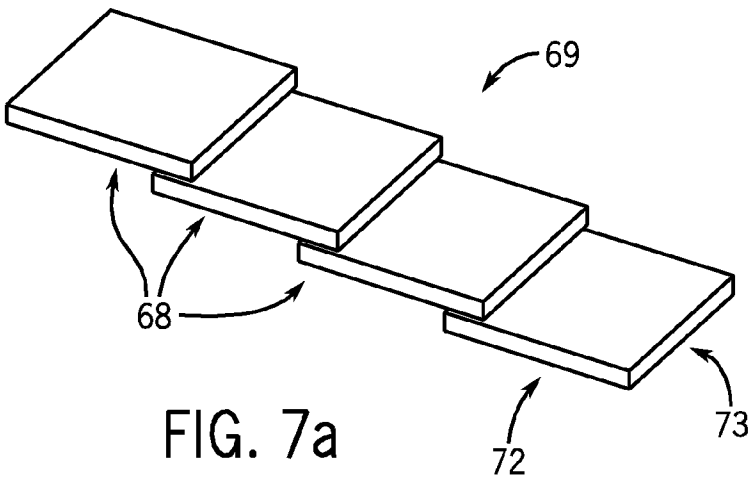
Figure 7C:
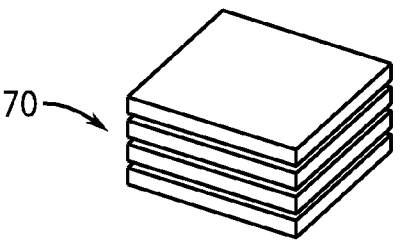
Figure 7B:
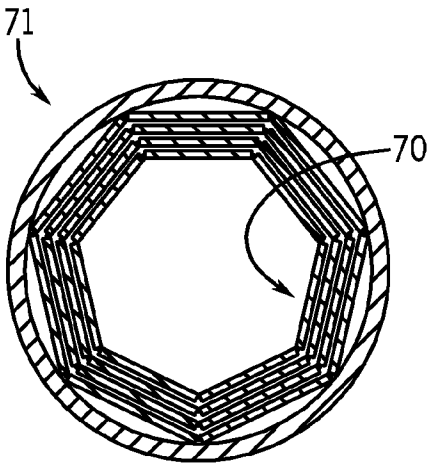

In an alternative embodiment of the embodiment of FIG. 6 is shown in FIG. 7*a*, in which the panels 68 are deployed telescopically to the deployed configuration as panels 69 shown in FIG. 7*a*. Guides (not shown) are provided on the edges of the panels 68 to allow their deployment to the extended position 69 and preferably their interlocking in the extended position. In FIG. 7*c*, one set of the panels 68 are shown in their pre-deployed configuration as panel sets 70. each of the panel sets 70 may be constructed similarly to the base cone described with regard to FIGS. 5*a*-5*e*. In FIG. 7*b*, the panel sets 70 are shown as mounted in the base 71 of the projectile (similar to the rolled-up longitudinal panels 64 in FIG. 6*a*). In the pre-deployed configuration shown in FIG. 7*b*, panel sets 70 are held in their un-deployed state via certain keeper or locking mechanisms (not shown). Numerous types of such locking mechanisms may be used. The locking mechanism may be designed to release the base cone due to the firing (setback) acceleration or set-forward acceleration or by certain programmed action such as release or cutting of a holding cable, bolt or any other known methods in the art. The panels 69 may be held together at certain intervals by certain means such as elastic elements or the like (not shown) or rings affixed to at least one set of panels located certain distance along the base cone to hold the panel 69 together to the desired shape of the base cone and also to provide the means to stiffen the base cone. The base cone may be provided with a cap as described for the aforementioned embodiments, which is affixed to the outer side 73 of the outer panels 72 (FIG. 7*a*).

Figure 8A:
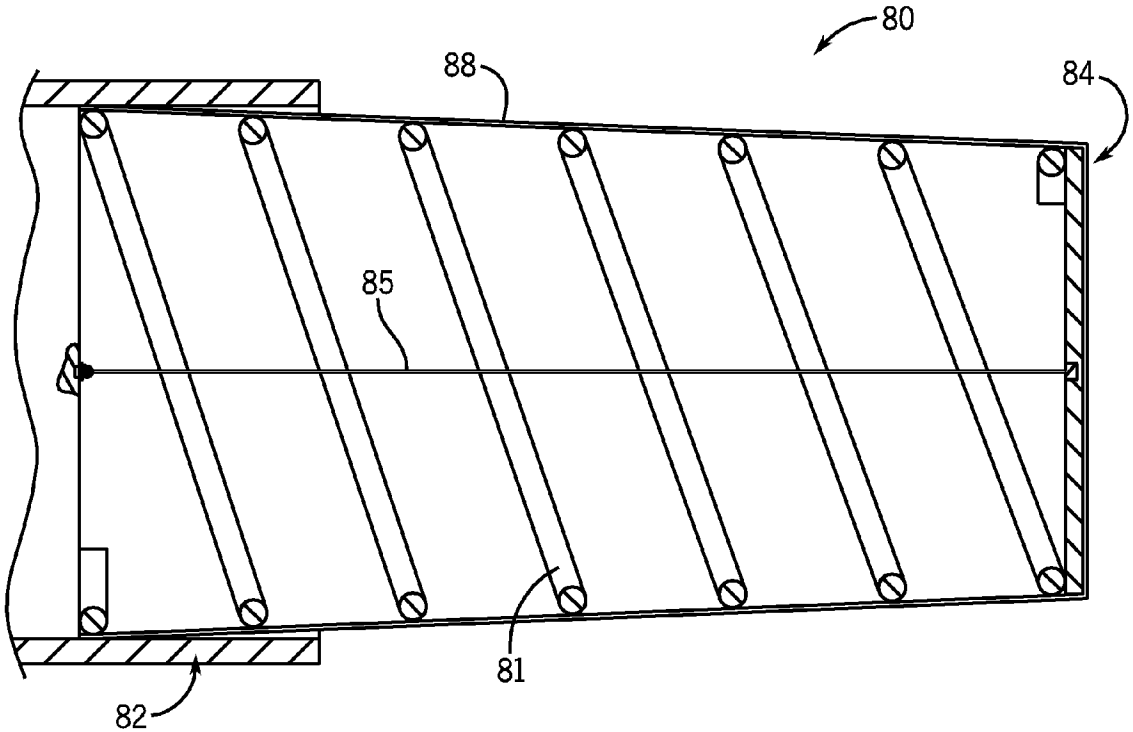
FIGS. 8*a* and 8*b* illustrate a seventh embodiment of a base cone for a munition, where
Figure 8B:
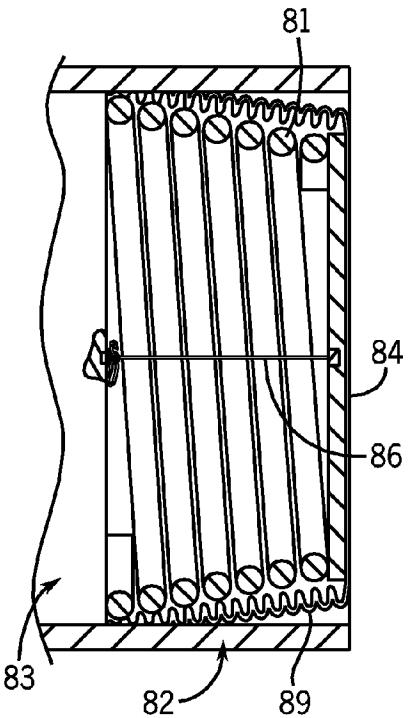

In yet another embodiment shown in FIG. 8, the base cone 80 consists of a tapered helical (or the like) spring 81 of circular or any other convenient cross section shown in its deployed configuration in FIG. 8*a*. In FIG. 8*b* the spring 81 is shown in the pre-deployed configuration of the base cone 80 as positioned at the base (preferably housing) 82 of the projectile 83. The base cone 80 is provided with a cap 84 (or an element with a similar structure) that can be affixed to the last coil of the spring 81. In the pre-deployment configuration of the base cone 80 shown in FIG. 8*b*, the spring 81 is biased to extend to its deployed configuration of FIG. 8*a* by preloading it in compression an appropriate amount.

In the pre-deployment configuration of the base cone 80 shown in FIG. 8*b*, the spring 81 is held in its un-deployed state via certain keeper or locking mechanisms. Numerous types of such locking mechanisms may be used. In the base cone 80, the spring 81 is locked in its deployed (extended) configuration shown in FIG. 8*a* by the cable 85, which is attached to the cap 84 on one end and to the base of the projectile 82 on the other end. In its pre-deployment configuration shown in FIG. 8*b*, the cable 85 is retracted to the length 86 (e.g., through a retaining ring 87) and locked in place. The locking mechanism (not shown) may be designed to release the base cone due to the firing (setback) acceleration or set-forward acceleration or by certain programmed action such as release or cutting of a holding wire or any other known methods in the art. The spring 81 is covered by a non-extensible fabric or the like 88. The covering 88 is preferably tightly held in place over the spring 81 when the base cone is deployed as shown in FIG. 8*a* and is folded and stored in the projectile base 82 (indicated by the numeral 89 in FIG. 8*b*) in the pre-deployed state of the base cone.

Figure 9A:
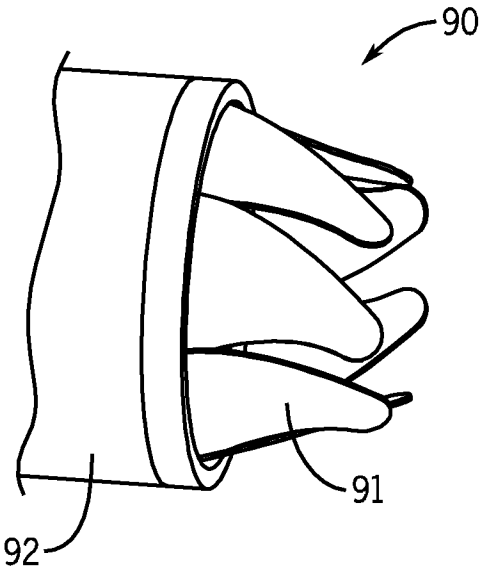
FIGS. 9*a* and 9*b* illustrate a eighth embodiment of a base cone for a munition, where
Figure 9B:
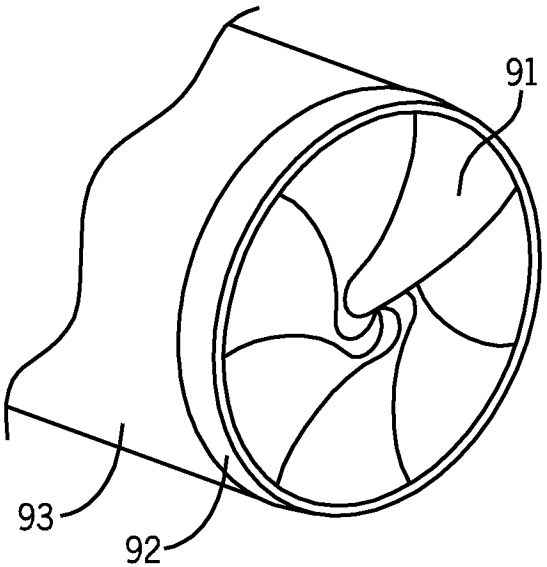

Another embodiment 90 is shown in FIG. 9. In this embodiment 90, plates 91 are attached to the base cavity 92 of the projectile 93 by joints that allow the plates to be rotated out from their pre-deployment position shown in FIG. 9*b* to their deployed position shown in FIG. 9*a* to form the base cone 90. The base cone provided by this embodiment 90 has relatively limited length equivalent to close to the diameter of the base cavity in which the plates 91 are mounted. In the pre-deployed configuration shown in FIG. 7*b*, the plates 91 are held in their un-deployed state via certain keeper or locking mechanisms (not shown). Numerous types of such locking mechanisms may be used. The locking mechanism may be designed to release the base cone due to the firing (setback) acceleration or set-forward acceleration or by certain programmed action such as release or cutting of a holding cable, bolt or any other known methods in the art. In their deployed configuration, the plates 91 may be held together at certain intervals by certain means such as elastic elements or the like (not shown) to provide the means to stiffen the base cone. The base cone plates 91 may form 3-dimensional surfaces such that in their deployed configuration they would collectively form a surface that covers the end of the base cone similar to the caps used to close the end of the base cones in the previously disclosed embodiments.

The mechanisms used to deploy the base cone in the above embodiments may be activated automatically, e.g., the firing setback or set-forward may act on an inertia element (displacing mass) to turn or displace a lever that unlocks the deployment mechanism (preferably by the force of a preloaded linear or rotary or other type of spring/elastic element).

In one embodiment, the aforementioned base cone deployment mechanism may be initially developed to a first length and cone angle and then sequentially to other sets of cone length and/or cone angles. Such sequential and step-wise base cone length and/or angle may be desirable to achieve optimal base cone configuration as the speed of travel of the projectile varies during the flight. The mechanism of varying the base cone length and/or angle can be actuated by sequential release of preloaded springs (which would require minimal electrical energy to achieve) as compared to the use of electrical motors which require a considerable amount of electrical energy and occupy a considerable amount of space.

It is appreciated by those familiar with the art that different types of structures, for example rings, struts, gussets, cables, etc., may be used to stiffen the base cones structures when necessary.

In many cases, the means used to deploy a base cone may also be used to stiffen the base cone structure. For example, a balloon may be inflated in the interior space of the embodiments of FIGS. 1-3, thereby causing them to deploy. The inflated balloon, particularly if it is constructed with relatively inextensible material, may also be used to stiffen the structure of the base cone and prevent it from collapsing.

The base cone caps (e.g., the caps in the base cone embodiments of FIGS. 1-3) are preferably provided with "support legs" or solid supports to cover the gap between the cap and the projectile base to allow the pre-deployed base cone resistant to high firing pressures. Alternatively, the projectile base may be formed to touch the cap surface to support them during the firing.

It is appreciated that the gap between the cap and the projectile base may be used by the projectile as an added available space for any purpose including for providing the means to generate base bleed gasses to further reduce drag during the flight.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A base cone for a projectile, the base cone comprising:

a cone member being movable between a retracted position and an extended deployed position, the deployed position being longer in an axial direction than the retracted position;

a member adapted to connect the cone member to a trailing portion of the projectile; and a release mechanism for releasing the cone member from the retracted position to the extended deployed position;

wherein the cone member comprises a plurality of ribbon members having a rolled configuration in the retracted position and at least partially unrolled configuration in the extended deployed position.

2. The base cone of claim 1, wherein the plurality of ribbons are connected to each other.

3. The base cone of claim 1, wherein the plurality of ribbons include stiffening ribs.

4. A base cone for a projectile, the base cone comprising:

a cone member being movable between a retracted position and an extended deployed position, the deployed position being longer in an axial direction than the retracted position;

a member adapted to connect the cone member to a trailing portion of the projectile; and a release mechanism for releasing the cone member from the retracted position to the extended deployed position;

wherein the release mechanism includes at least first and second release mechanisms, the first release mechanism being adapted to extend the cone member in a first extended deployed position and the second release mechanism being adapted to extend the cone member in a second extended deployed position, the second extended deployed position being longer in the longitudinal direction then the first extended deployed position.

* * * * *